United States Patent [19]

Karinthi et al.

[11] 4,085,252

[45] Apr. 18, 1978

[54] COMPOSITE WIRE WITH A BASE OF CERIUM AND OTHER RARE EARTHS

[75] Inventors: Pierre Karinthi, Jouy-en-Josas; Michel Dauvergne, Osny; Benoît Hirschauer, Pontoise, all of France

[73] Assignee: L'Air Liquide, Societe Anonyme Pour l'Etude et l'Exploitation des Procedes Georges Claude, Paris, France

[21] Appl. No.: 677,545

[22] Filed: Apr. 16, 1976

[30] Foreign Application Priority Data

Apr. 18, 1975 France ..... 75 12060

[51] Int. Cl.[2] ..... B23P 3/00; C21C 7/00; B21F 19/00

[52] U.S. Cl. ..... 428/576; 75/53; 75/129; 428/681

[58] Field of Search ..... 29/196, 183.5, 191.6; 75/129, 53, 58; 428/924–926, 681, 576

[56] References Cited

U.S. PATENT DOCUMENTS

| | | | |
|---|---|---|---|
| 3,729,309 | 4/1973 | Kawawa | 75/129 |
| 3,768,999 | 10/1973 | Ohkubo | 75/53 |

*Primary Examiner*—Peter D. Rosenberg
*Attorney, Agent, or Firm*—Lee C. Robinson, Jr.

[57] ABSTRACT

The invention relates to a composite wire with a base of cerium and/or rare earths such as mischmetal and intended for insertion into a bath of molten steel so as to de-oxidize and de-sulphurize the steel. When this composite wire is inserted into molten steel, it controls certain inclusions by converting manganese sulphides to sulphides of rare earths, thereby improving the resilience characteristics of the steel. The composite wire is obtained by enclosing the mischmetal wire in a metallic sheath. The diameter of the wire, the thickness of the sheath and the speed of injection are determined in accordance with characteristic curves representing particular proportional relations.

8 Claims, 7 Drawing Figures

COMPOSITE WIRE WITH A BASE OF CERIUM AND OTHER RARE EARTHS

Figure 1:
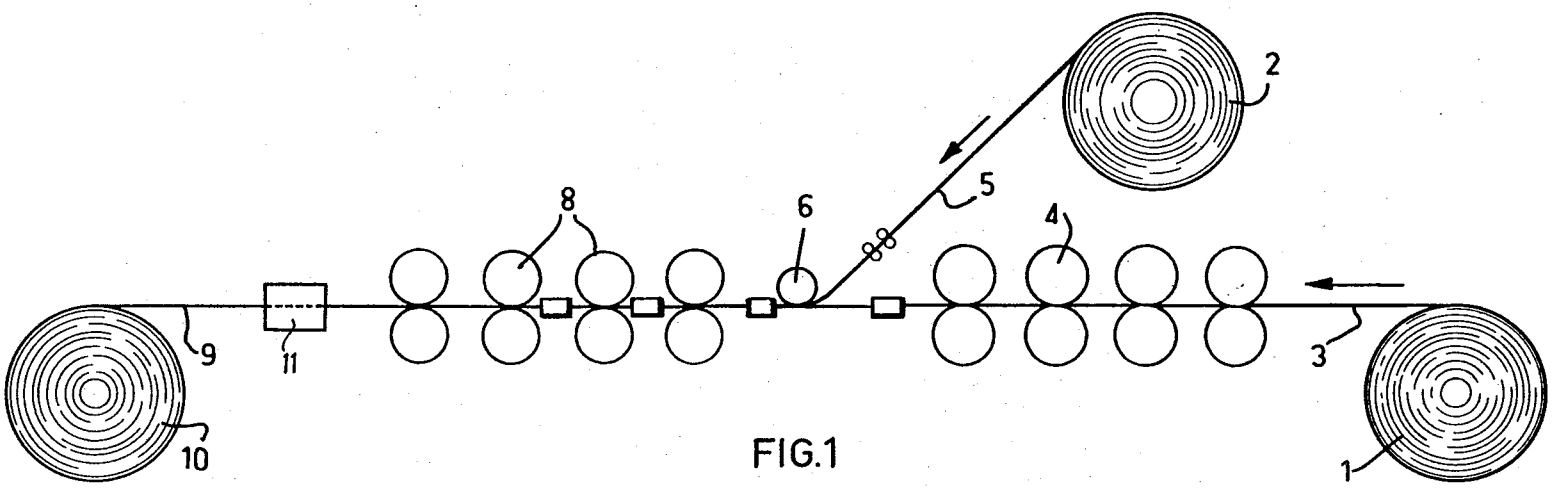

The present invention relates to a composite wire with a base of cerium and other rare earths, intended to be injected into a bath of molten steel, in such manner as to modify the composition of the steel with respect to certain compounds of low content, in order to modify the characteristics of the finished metal, especially its resilience characteristics.

It is known that the addition of cerium and other rare earths, such as "mischmetal", (which form a complex product also known as mischmetal) to molten steel permits the steel to be de-oxidized and de-sulphurized, and thus enables the morphology of certain non-metallic inclusions to be checked, especially by converting certain sulphides of manganese to sulphides of rare earths.

In view of the great chemical reactivity of cerium and the rare earths generally, it is very difficult to achieve homogeneous dilution when they are added to the bath of molten metal. For example, during normal, or discontinuous pouring, operation it has been proposed to introduce the cerium into the pouring ladle in the form of a rod, but this cerium rod leads to the production of a more pasty liquid bath. Consequently pouring of the bath is thereby rendered more difficult. It has also been proposed to introduce the cerium directly into the ingot moulds. However in this technique, the cerium is badly distributed throughout the mass, and defects are produced at the ingot foot with an unsatisfactory surface appearance.

In the case of continuous pouring, the introduction of cerium, either directly into the pouring ladle or into the pouring distributor which follows this ladle, gives rise to the above-mentioned disadvantage of producing a more pasty metal resulting in more difficult pouring, either at the pouring ladle or the pouring distributor or at the pouring nozzles.

If the cerium is introduced at the continuous-pouring ingot-mould, it is necessary to supply a fixedly proportioned amount of cerium during the entire pouring duration. This addition cannot be made in the form of a wire of mischmetal, since there arises a certain difficulty in passing through the surface slag due to a voilent reaction at the zone of introduction into contact with the steel. In order to overcome this drawback, it has been proposed to introduce a wire of mischmetal into the ingot mould by passing it through a refractory tube which dips into the bath of liquid metal. Experience has shown however that the refractory tube very rapidly becomes blocked.

Whatever the methods of introduction of a cerium wire, it must however be noted that the result is the presence of cerium in the covering flux of the liquid metallic bath, which modifies the essential properties of this covering flux, consisting of lubricating and protecting against oxidation. In addition, as the mischmetal has a relatively low melting point, on the order of 800° C. to 900° C., it melts without penetrating into the heart of the molten mass of metal. Its distribution is therefore not homogeneous and is essentially limited to a zone close to the surface of the bath of metal.

In alternative metal treating techniques, it has been proposed to introduce into the bath of molten metal a meltable or oxidizable substance, for example aluminum, magnesium or sodium, in the form of powder placed in a protective casing of steel in such manner that the protective casing does not melt until it reaches a certain depth below the surface of the metal bath. This casing permits an easier passage through the surface slag and the fusible or oxidizable substance then can melt at the heart of the mass, thereby facilitating a homogeneous dilution.

It has also been proposed, in order to de-oxidize a liquid steel, too introduce into the metal bath a composite wire formed of an aluminium core sheathed inside a steel tube having a wall thickness of 1.5 millimeters (mm), in such manner that the aluminium melts with its steel sheath at a zone located below the point of impact of the pouring jet. Thus, in the case of treatment of liquid steel by aluminium, there is ensured a suitable distribution effect of the aluminium in the molten metallic mass.

This invention is directed to a new application and a particular adaptation to cerium of such a process, previously provided exclusively for and adapted to the introduction of aluminium into a metallic bath.

It is an object of this invention to provide an improved composite wire formed of at least one rare earth element, such as cerium, adapted for insertion into a molten metal bath that does not melt until a satisfactory depth of penetration is reached; that can be easily manufactured, stored and used; and that is provided with particular dimensions that are interrelated in accordance with a predetermined relationship.

The invention directed to a composite wire, having a core constituted by a pre-established wire of cerium and/or other rare earths, whose diameter is between 1.4 and 8.5 mm., closely sheathed by a metallic casing having a thickness between 0.1 and 1 mm. From practical tests it has been found to be relatively easy to form a steel sheath of this thickness around a cerium wire, whereby the melting of the cerium is delayed. In previous attempts to delay the melting of cerium introduced into a bath of molten metal a mischmetal powder, associated with silicon or aluminium, to form the internal compound of a tubular steel wire, was used.

Such attempts have not proved satisfactory, in particular because the filling rate (the ratio between the feed rate and the total weight of the composite wire per unit length) is relatively small, and cannot generally exceed 36%, with the content of mischmetal (ratio between the weight of mischmetal and the total weight of the composite wire per unit length) from 10 to 27%. The wire diameter should be of certain dimensions in order to ensure easy winding and unwinding, and this coupled with the low filling rate and small mischmetal content makes it necessary to utilize very high introduction speeds for the wire. Alternatively a number of such wires must be introduced simultaneously.

On the other hand, by utilizing, instead of mischmetal in powder form, a previously prepared single wire of michmetal, it is possible to ensure, with ribbon-sheathing techniques, a rate of filling with mischmetal and a content of mischmetal on the order of 62%.

In addition to this advantage, the use of a previously prepared mischmetal wire instead of powders with a mischmetal base, makes it possible to avoid any appreciable oxidation of the mischmetal which, as is well known, has a great affinity for oxygen. Consequently, with the teachings of this invention, it is possible to maintain a constant quantity of mischmetal along the length of the wire thus sheathed, whereas wires that have been packed with mischmetal powders have very different densities due to their oxidation, which results in risks of breaking during the drawing of the composite wire, and also results in a very variable proportion of active cerium in the steel on continuous pouring.

Figure 5:
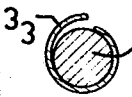
Figure 6:
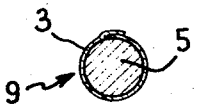
Figure 7:
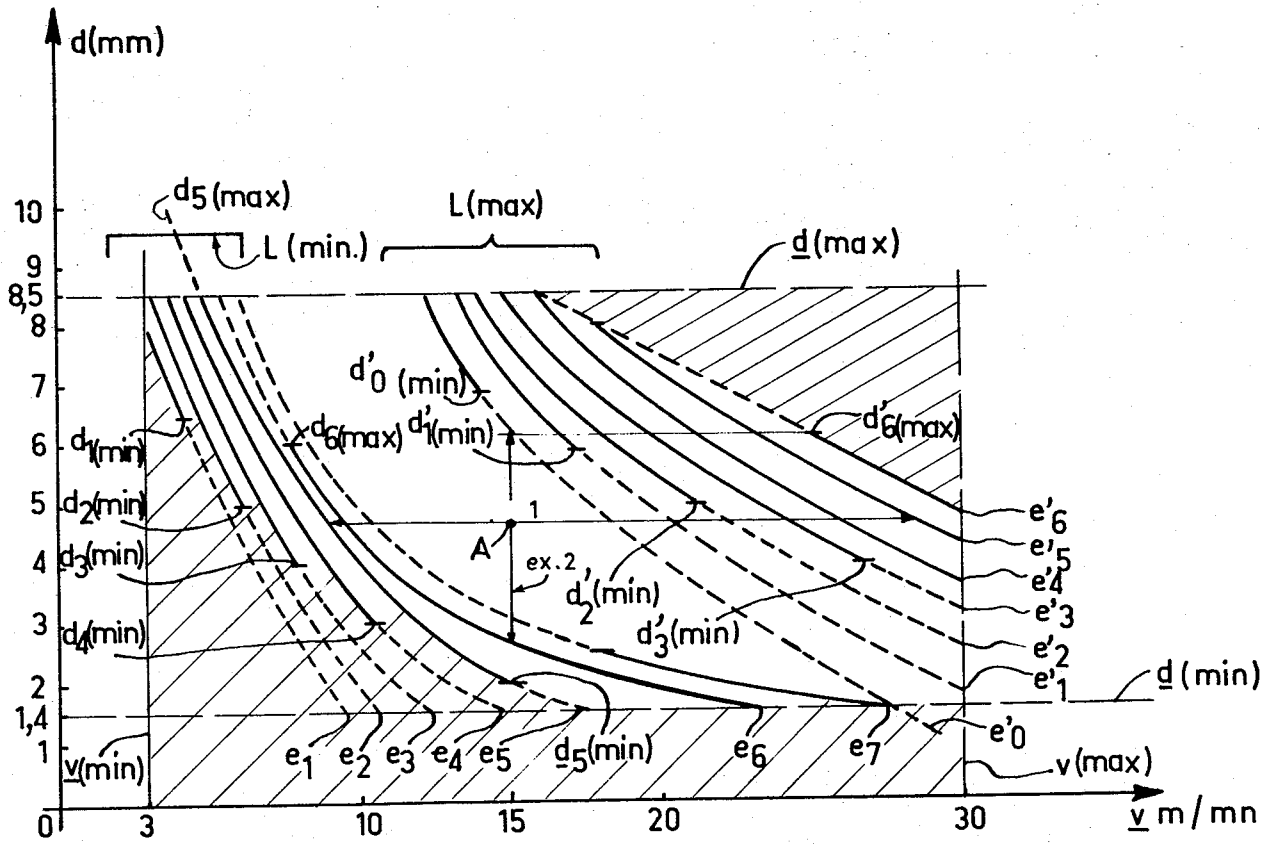

The accompanying drawings show in a diagrammatic manner a method of manufacture of a wire formed of a base of cerium sheathed with steel. In these drawings, FIG. 1 is a longitudinal view of a manufacturing installation of such a wire;

FIGS. 2, 3, 4, 5 and 6 are transverse sections of the wire produced at various locations along the manufacturing installation; and FIG. 7 is an explanatory diagram.

Figure 2:
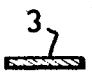
Figure 3:
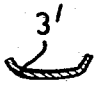

Referring now to the accompanying drawings, a manufacturing installation for wire formed of a base of cerium sheathed with steel comprises a ribbon storage magazine 1 for a steel ribbon 3 having a thickness of 0.4 mm. and a storage magazine 2 for mischmetal wire. The ribbon 3, unwound from the magazine 1 is flat, as shown in FIG. 2 and is progressively shaped by shaping rollers 4 to the form of a gutter 3; as shown in FIG. 3.

Figure 4:
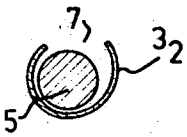

When this gutter is sufficiently incurved as shown at $3_2$ in FIG. 4, a wire 5 of cerium having a diameter of 4 mm. is unwound from the magazine 2 and is introduced by a roller 6 through a passage 7 in the ribbon gutter $3_2$, after which shaping rollers 8 increasingly close the ribbon $3_3$, as shown in FIG. 5, until this ribbon completely encloses the cerium wire 5, as shown in FIG. 6, the closure overlapping the edges of the ribbon.

The composite wire 9, as shown in FIG. 6, is then drawn at 11 and wound on a storage drum 10. The subsequent utilization of this composite wire 9 is effected by conventional unwinding and guiding means (not shown) which permit the direct introduction of the composite wire 9 into a bath of molten metal.

The composite wire formed of a base core of cerium sheathed with steel may be produced with particular relative dimensions wherein the diameter of the cerium wire is from 1.4 to 8.5 mm., and the thickness of the sheath is between 0.1 and 1 mm., which dimensions result from the explanations which follow, with reference to FIG. 7:

1. The diagram of FIG. 7 represents generally the relationship between diameter $d$ (expressed in millimeters) of the core of cerium wire and the speed of introduction $v$ (expressed in meters per minute (m/min)) of the opposite wire into the liquid metal.

For reasons of industrial practice, it is assumed that the cerium wire cannot have a diameter less than 1.4 mm., since below this value the sheathing operation is subjected to considerable difficulties. On the other hand, it is considered that the cerium wire cannot have a diameter greater than 8.5 mm., since above this diameter winding and unwinding of the wire are subjected to difficulties.

In FIG. 7, these two limits have therefore been drawn in the form of two lines parallel to the abscissae, at the ordinate 1.4 mm. ($d_{min}$) and at the ordinate 8.5 mm. ($d_{max}$) respectively.

2. The speed of introduction $v$ meters/min. of the composite wire into the molten metal must be confined within certain limits. On the one hand, it is essential that the speed $v$ should be greater than 3 m/min in order to accurately maintain a constant quantity of cerium introduced per ton of metal treated. On the other hand, this speed $v$ must be less than 30 m/min for reasons of safety and to permit the wire unwinding operation to be performed successfully. These two limits are shown by two lines parallel to the ordinates, at the abscissa 3 m/min ($v$ min) and at the abscrissa 30 m/min ($v_{max}$) respectively.

3. Following tests, it was found experimentally that the depth of penetration (L) in meters was related to the structure of the wire (the diameter $d$ of the cerium core and the thickness $e$ of the sheath) and to the speed of introduction $v$ m/min by the equation:

$$L = 1.7\,(e + 0.35\,d)v \cdot 10^{-2}$$

If the depth of penetration is selected, it will be appreciated that it is then possible to draw, for each selected depth of penetration L, a family of curves expressing the diameter $d$ (mm.) of the cerium core as a function of the speed of introduction $V$ (m/min) for various values of the thickness of sheath $e$ (mm.), as represented in FIG. 7.

The depth of penetration L must in any case be greater than 0.3 meter, otherwise the cerium is liable to come into contact with the slag covering the molten metal.

The depth of penetration should be less than 1 meter, otherwise there is a lack of precision in the handling of the wire, which is liable to catch on or be obstructed by a solidified wall of the steel bloom. Beyond this depth, on the other hand, there is a loss of homogeneity of in the distribution of the cerium, since a substantial part of the steel at this depth is already solidified.

There are shown in FIG. 7, two families of curves $d$ as a function of $e$. The first series, on the left-hand side of the diagram, corresponds to the minimum depth of penetration $L_{min}$ of 0.3 meter for successively decreasing thicknesses of the ribbon $e$: $e_1 = 1.25$ mm; $e_2 = 1$ mm.; $e_3 = 0.80$ mm.; $e_4 = 0.60$ mm.; $e_5 = 0.40$ mm.; $e_6 = 0.25$ mm.; $e_7 = 0.1$ mm.

The second series of curves on the right-hand side of the diagram corresponds to the maximum depth of penetration $L_{max}$ of 1 meter for successively decreasing thicknesses of ribbon $e$: $e'_o = 1.50$ mm.; $e'_1 = 1.25$ mm.; $e'_2 = 1.00$ mm.; $e'_3 = 0.80$ mm.; $e'_4 = 0.60$ mm.; $e'_5 = 0.40$ mm. $e'_6 = 0.25$ mm. It will be observed that for each given depth only the curves in which the thickness $e$ is greater than 0.1 mm. and less than 1 mm. are considered. This excludes from the invention the curves such as $e_1$ (for $L_{min}$), and $e'_o$ and $e'_1$ (for $L_{max}$).

4. As yet another condition the thickness $e$ (mm) must be greater than $0.04 \times d$ (mm), since a thickness less than this value would result in a wire that is too fragile. In other words, for each thickness $e_1, e_2 \ldots e'_1, e'_2 \ldots$ there can be determined maximum diameters of cerium wires $d_1$ max, $d_2$ max . . . $d'_1$ max, $d'_2$ max . . . of which some have been represented by a very short line.

On the other hand, the thickness $e$ (mm) must be less than $0.2 \times d$ (mm), otherwise the wire would be too stiff, too difficult to manufacture, and too difficult to wind and to unwind. In other words, for each thickness $e_1, e_2 \ldots e'_1, e'_2 \ldots$ the minimum diameters of the cerium wire can be determined: $d_1$ min, $d_2$ min . . . $d'_1$ min, $d'_2$ min . . . some of which have also been shown by a very short line.

The diagram shown in FIG. 7 enables the wire of appropriate core diameter and sheath thickness to be determined for desired inslution speeds.

The zones external to delimited the rectangle and the shaded zones are prohibited for use.

A ribbon of given thickness $e$ has two representative curves, one corresponding to the maximum depth of penetration ($L_{max}$) of 1 m., the other to a minimum depth ($L_{min}$) of 0.3 m. For each of these curves a lower limit $d_1$ min, $d_2$ min . . . $d'_1$ min, $d'_2$ min . . . or an upper limit $d_1$ max, $d_2$ max . . . $d'_1$ max, $d'_2$ max . . . restrict the acceptable diameter.

EXAMPLES OF UTILIZATION

1. If the thickness of ribbon is selected as 2.4 mm. ($e_5$ in the drawing), the diameter of the mischmetal wire may be between 2 mm. (lower limit $d_5$ min in the left-hand family of curves) and 8.5 mm. (upper limit $d$ max on the two families of curves).

If between these limits the diameter is fixed at 4.7 mm., the speed $v$ of injection may be between 8.8 m/min and 28.8 m/min as shown by the straight line marked "example 1".

2. If the speed of injection $v$ is fixed at 15 m/min and the ribbon thickness $e$ is fixed at 0.25 mm. ($e_6$ in the drawing), the core diameter $d$ may be between 2.7 mm. (lower limit corresponding to the minimum penetration $L_{min}$) and 6.3 mm. (upper limit corresponding to the maximum permissible diameter $d'_6$ max for this thickness of ribbon) as indicated by the straight line marked "2" on the drawing, by way of example.

3. If the core diameter $d$ is fixed at 4.7 mm. for example, and the speed of injection $v$ is fixed at 1.5 m/min for example (point A on the drawing), the minimum thickness $e$ of the ribbon is 0.19 mm. and its maximum thickness is 0.94 mm., these limits corresponding to the solidity and the stiffness of the wire.

As previously indicated, the invention is applicable to the preparation of poured steels and especially of continuously poured steels.

What we claim is:

1. A composite wire having a core formed of at least one rare earth element, said core being enclosed inside a metallic casing and having a diameter $d$ between 1.4 and 8.5 mm. tightly enclosed by said metallic casing, said casing having a thickness $e$ between 0.1 and 1 mm., wherein $e$ is greater than 0.04 $d$ and less than 0.2 $d$.

2. A composite wire as claimed in claim 1, in which said metallic casing is a steel ribbon enclosing said core with overlapping of the longitudinal edges of said ribbon.

3. A composite wire for insertion into a bath of molten steel, comprising a core formed of cerium having a diameter $d$ between 1.4 and 8.5 mm. enclosed by a steel sheath having a thickness $e$ between 0.1 and 1 mm. wherein $e$ is greater than 0.04 $d$ and less than 0.2 $d$.

4. A composite wire for insertion into a bath of molten steel, comprising a core formed of cerium and at least one other rare earth element, said core having a diameter $d$ between 1.4 and 8.5 mm. enclosed by a metallic sheath having a thickness $e$ between 0.1 and 1 mm., wherein $e$ is greater than 0.04 $d$ and less than 0.2 $d$.

5. A composite wire for insertion into a bath of molten steel to a depth L at a speed of insertion $v$, said wire comprising a core formed of cerium and having a diameter $d$ enclosed by a steel sheath having a thickness $e$, wherein L, $v$, $d$ and $e$ are related as:

$$L = 1.7\,(e + 0.35\,d)\,v \times 10^{-2} \text{ meters}$$

and wherein $d$ is between 1.4 and 8.5 mm.

6. A composite wire according to claim 5 wherein $e$ is greater than 0.04 $d$ and less than 0.2 $d$.

7. A composite wire according to claim 5 wherein L is greater than 0.3 and less than 1 meter.

8. A composite wire according to claim 5 wherein $v$ is greater than 3 m/min. and less than 30 m/min.

* * * * *